United States Patent [19]

Perri

[11] Patent Number: 5,065,986

[45] Date of Patent: Nov. 19, 1991

[54] AUTOMATIC GAS HOOKUP TO A LADLE

[75] Inventor: Joseph A. Perri, Coraopolis, Pa.

[73] Assignee: Insul Company, Inc., East Palestine, Ohio

[21] Appl. No.: 559,835

[22] Filed: Jul. 30, 1990

[51] Int. Cl.[5] ..... C21C 5/46

[52] U.S. Cl. ..... 266/217; 266/265

[58] Field of Search ..... 266/216, 217, 265, 268, 266/218, 287, 270, 266, 267

[56] References Cited

U.S. PATENT DOCUMENTS 4,502,670 3/1985 Goebel et al. ..... 266/265

4,883,259 11/1989 Stomp et al. ..... 266/217

*Primary Examiner*—S. Kastler

*Attorney, Agent, or Firm*—Harpman & Harpman

[57] ABSTRACT

This invention provides an apparatus for automatically connecting a gas supply to a vessel employed to contain molten metal whereby gas, such as argon, is injected into the molten metal in a selected interior portion of the vessel, such as a ladle.

The ladle is positioned on a tilting structure so that it can be tipped to flow out slag on the top on the molten metal, the slag and other impurities in the metal being directed to the top thereof by the upwardly flowing argon gas.

The apparatus comprising an upstanding male connection mounted on the tilting structure so as to be engageable in a downwardly facing female connection mounted on the ladle. The connections are shaped to insure a substantially gas tight connection whereby gas in a desired volume at a desired pressure are introduced into the ladle.

5 Claims, 4 Drawing Sheets

AUTOMATIC GAS HOOKUP TO A LADLE

BACKGROUND OF THE INVENTION

1. Technical Field

This invention relates to an apparatus for coupling a metallurgical ladle to a gas supply for the treatment of molten metal contained in the ladle. The gas is injected into the molten metal at a desirable location, usually near the bottom of the ladle, as for example by a lance as known in the art. The gas is injected at a treatment station in which the ladle is placed on a tilting structure and heretofore the gas connection has been made by hand, which operation entails the risks of accidents. A semi-automatic coupling has been proposed whereby a coupling head is connected through the action of a jack to one of the side suspension trunions of the ladle which requires a specially designed trunion to be effective.

2. Description of the Prior Art

U.S. Pat. No. 4,502,670 discloses an apparatus which connects a gas discharging device in a pocket block in the bottom of a ladle or other vessel to an apertured plate arranged for surface contact with an apertured body member by way of engaging flat surfaces, the body member being spring urged with respect to a supporting base. The construction requires a particular sort of supporting base and a particular sort of a ladle surface for effective use.

U.S. Pat. No. 4,883,259 discloses a horizontally slidable base carrying an apertured upstanding male connection head for engagement with a spring urged female connection member mounted on the ladle. The apparatus incorporates multiple springs theoretically functioning to permit movement of the respective connection portions in the event of misalignment of the same and is subject to operating difficulties in the presence of molten slag or metal as frequently occurs.

Such prior structures of this type have accordingly not been successfully used in actual steelmaking facilities.

The present invention eliminates many of the problems associated with attempting automatic hookup of a gas supply line to a ladle containing molten metal and provides a simpler apparatus with very few moving parts and thereby able to function successfully in a critical location.

SUMMARY OF THE INVENTION

The above-discussed and other problems and disadvantages of the prior art are overcome or alleviated by the automatic gas hookup apparatus of the present invention.

The present invention provides a coupling device which will permit entirely automatic connection to the gas supply by placing the ladle on the tilting structure as commonly used in the art.

A preferred embodiment of the automatic gas hookup to a ladle comprises an upstanding male connection member flexibly mounted on the conventional tilting structure supporting the ladle and incorporating a spring urged uppermost portion having a modified convex curved upper end with a downwardly extending annular flange engaged on a circular plate which is supported on the upper end of a coil spring. A downwardly facing female connection member is secured to an annular flange on the ladle and incorporates a half spherical concave member of a diameter larger than the plate and downturned annular flange of the upstanding male member, whereby the different shapes and sizes of the modified convex curved upper end of the male member will, at its peripheral edge above the downturned annular flange, sealingly engage the inner concave surface of the half spherical female connection member in a number of positions as occur when the ladle is positioned on the tilting structure. The half spherical concave member and the modified convex curved upper end of the two portions of the device are apertured to provide a gas passageway as will be understood by those skilled in the art. The half spherical concave member has an outwardly and downwardly annular conical flange of a maximum diameter at its lower end substantially greater than that of the upstanding male connection head to insure the automatic engagement of the respective connection members.

DESCRIPTION OF THE PREFERRED EMBODIMENT

Figure 1:
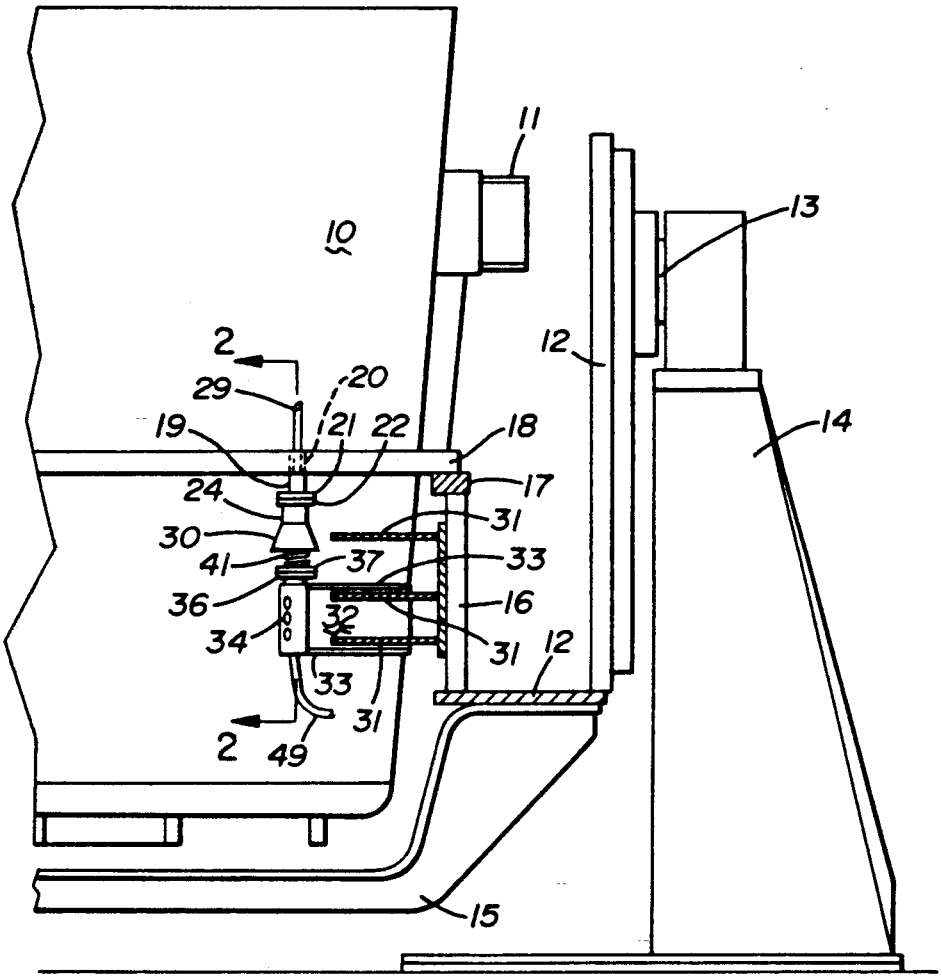
FIG. 1 is a side elevation with parts broken away illustrating a portion of a tilting structure, a ladle positioned thereon, and the automatic gas hookup apparatus in engaged relation.

By referring to the drawings and FIG. 1 in particular, it will be seen that a ladle 10 has been partially illustrated with one of its trunions 11 extending sidewardly therefrom and in spaced relation to an upstanding portion of a tilting structure 12 which in turn is movably mounted on one of its trunions 13 on a supporting structure 14.

The tilting structure 12 includes a transversely extending frame member 15 and an upstanding support 16 for several ladle saddles 17. The ladle saddles 17 are spaced outwardly of the ladle 10 and are positioned below an annular ladle flange 18 on the ladle 10 as common in the art. Those skilled in the art will observe that the tilting structure is conventional and that it is provided with means, not shown, for tilting the same and the ladle 10 therein.

Still referring to FIG. 1 of the drawings, it will be seen that there is a tube 19 secured to the lower portion of the ladle flange 18.

Figure 2:
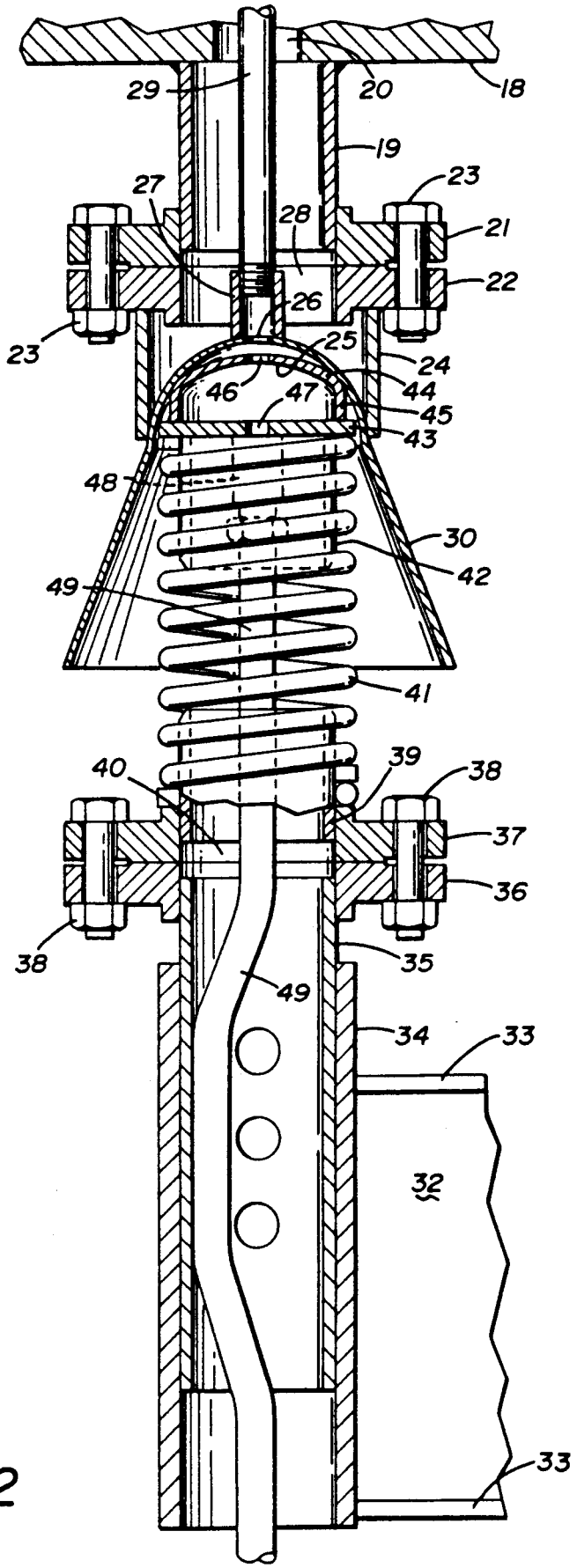
FIG. 2 is an enlarged vertical section of the automatic gas hookup on line 2—2 of FIG. 1.

By referring to FIG. 2, it will be seen that the tube 19 is in registry with an opening 20 in the annular flange 18. The lower end of the tube 19 is secured in a first coupling plate 21 which is fastened to a second coupling plate 22 by suitable fasteners 23. A cylindrical body 24 is attached to the second coupling plate 22 and depends therefrom. A half spherical concave member 25 is positioned within the cylindrical body 24 and is attached thereto so as to be supported thereby. It is apertured at its uppermost end as at 26 and a tubular member 27 is attached thereto and extends upwardly into a chamber 28 formed in the first and second coupling plates 21 and 22 where it is engaged on a pipe 29 which extends upwardly through the opening 20 in the ladle flange 18.

The half spherical concave member 25 has a downwardly and outwardly conical flange 30, the lower open end of which is substantially double the diameter of the upper end thereof.

By referring again to FIG. 1 of the drawings, it will be seen that the downwardly and outwardly conical flange 30 comprises the lower portion of the downwardly facing female connection. In FIG. 1 of the drawings, horizontally disposed gussets are affixed to the upstanding support 16 of the tilting structure 12 so as to define corner constructions as best seen, for example in FIG. 4 of the drawings.

Figure 4:
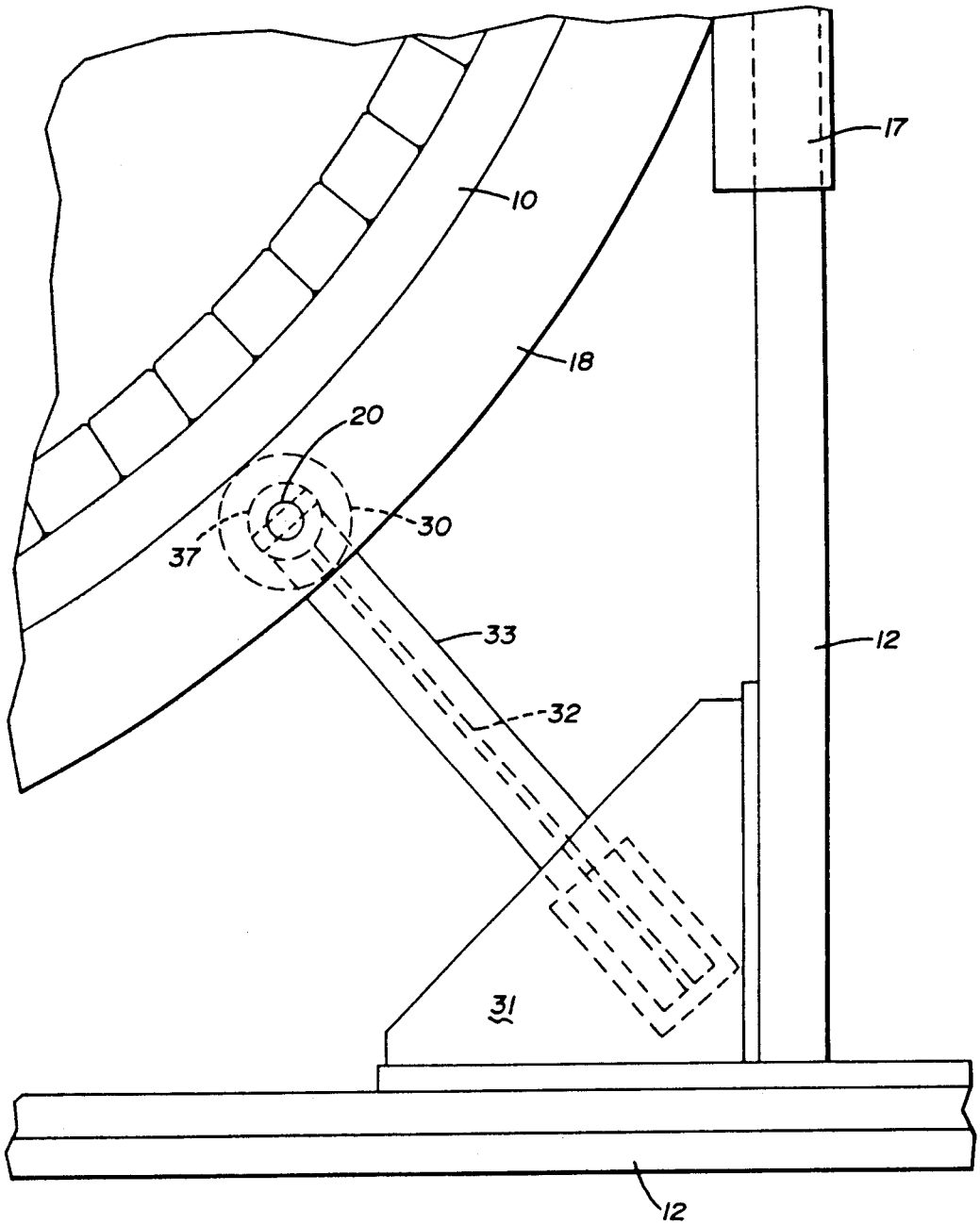
FIG. 4 is an enlarged top plan of the automatic gas hookup of FIG. 3.

A vertically aligned support beam 32 is attached adjacent its upper and lower edges 33 to a pair of the gussets 31 so as to extend outwardly therefrom toward the ladle 10 as best seen in FIG. 4 of the drawings and still referring to FIG. 1, it will be seen that the upstanding male connection member is supported thereby.

By referring to FIG. 2 of the drawings, it will be seen that the upstanding male connection member comprises a first telescopic body member 34 in which a second telescopic body member 35 is adjustably postioned. Openings in the respective first and second body member permit fasteners to be positioned in different openings to fix the relative positions of the first and second telescopic body members to provide vertical adjustment.

The first telescopic body member 34 is attached to the outermost end of the vertically aligned supporting beam 32 and the upper end of the second telescopic body member 35 is secured to a third coupling plate 36 which in turn is secured to a fourth coupling plate 37 by fasteners 38. An upstanding tubular guide 39 engages a chamber 40 formed by the third and fourth coupling plates 36 and 37 respectively, and a coil spring 41 is partially engaged thereover so as to stand vertically above the fourth coupling plate 37.

In practice, the coil spring 41 is approximately a foot long and is formed of heavy-duty steel rod. The upper end of the coil spring 41 is engaged over a secondary tubular guide 42, the upper end of which is secured to an upper plate 43. A modified convex curved upper end portion 44 is positioned on the upper surface of the upper plate 44, it being observed that the modified convex curved upper end portion 44 has an annular downturned flange 45 which is attached to the upper surface of the upper plate 43 thereby spacing the modified convex curved upper end portion 44 thereabove. The upper plate 43 is of a diameter less than the inner diameter of the half spherical concave member 25 heretofore referred to, and is of a curvature which if continued in a spherical shape would result in a diameter greater than the diameter of the half spherical connection member 25. Apertures 46 and 47 are formed in the modified convex curved upper end portion 44 and the upper plate 43 respectively and a secondary tubular member 48 is attached to the lower surface of the upper plate 43 in registry with the aperture 47 and forms a fitting to which a flexible tube 49 is attached. The flexible tube 49 leads downwardly through the coil spring 41, the chamber 40 in the third and fourth coupling plates 36 and 37 respectively and through the second and first telescopic body members 35 and 34 respectively, and out of the lower end thereof where it continues to a source of argon gas or the like controlled by an automatic valve, not shown.

Figure 3:
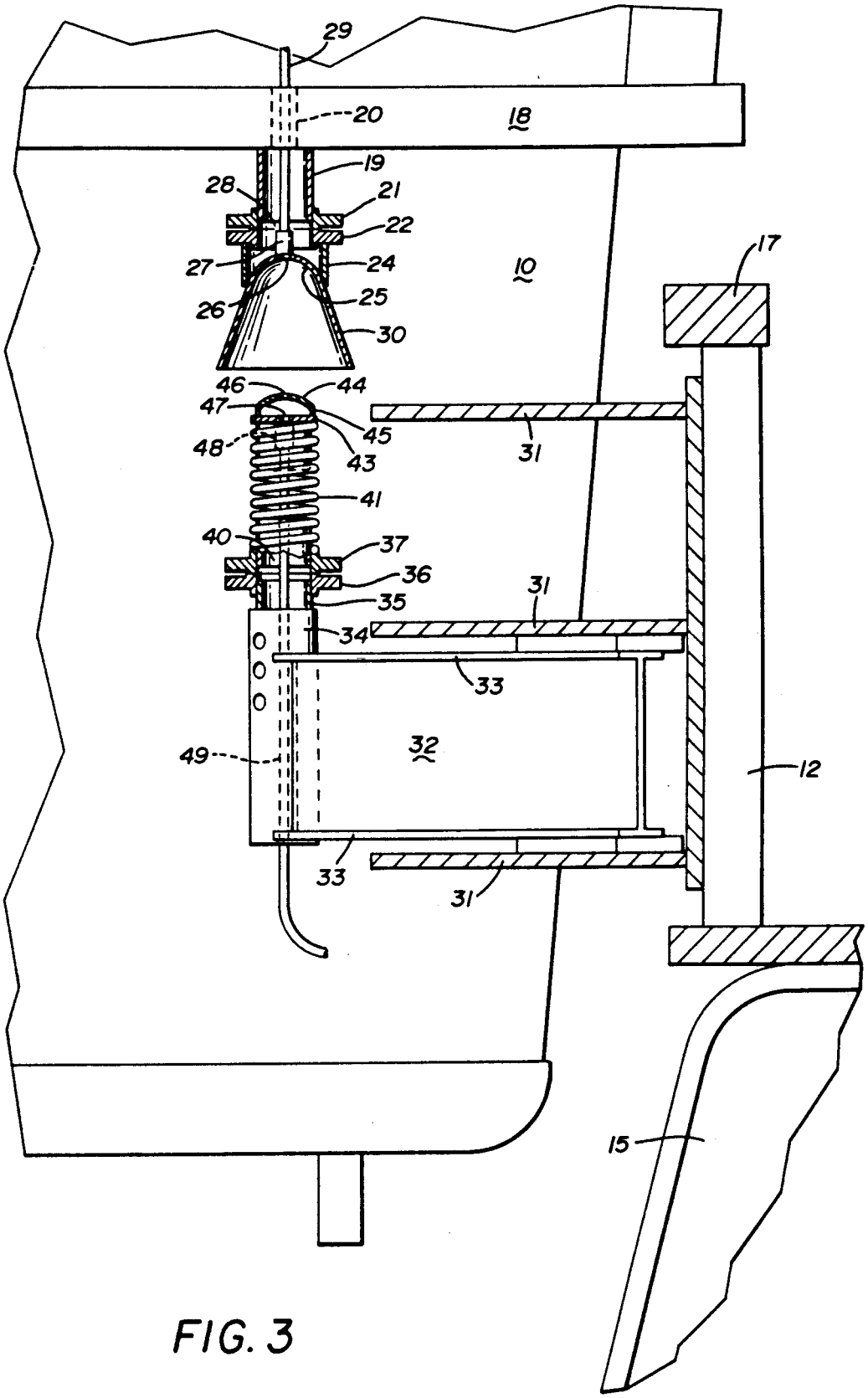
FIG. 3 is a vertical section similar to FIG. 2 showing the female connection of the apparatus and the ladle in elevated relation to the upstanding male connection and the tilting structure on which it is supported.

By referring now to FIG. 3 of the drawings, it will be seen that the ladle 10 is shown in elevated relation to the positions thereof as illustrated in FIGS. 1 and 2 of the drawings and heretofore described.

In FIG. 3 of the drawings, the downwardly facing female connection, including the tube 19, the first and second coupling plates 21 and 22, the cylindrical body 24, the half spherical concave member 25 and its downwardly and outwardly tapering flange 30, all of which are carried by the annular flange 18 of the ladle 10, are illustrated in position above the upstanding male connection including the modified convex curved upper end portion 44, the upper plate 43, the coil spring 41, the third and fourth coupling plates 36 and 37 respectively, the second telescopic body member 35 and the first telescopic body member 34.

The first telescopic body member 34 is shown attached to the outer end of the support beam 32 which in turn is attached at its opposite end to a pair of the gussets 31.

It will be observed that the relative size and positioning of the downwardly facing female connection is such that despite irregularities in the positioning of the ladle 10 in the tilting structure 12, the connection members will automatically engage and because of their unique configuration, result in a substantially tight gas sealing engagement. This desirable sealing engagement occurs because of the half spherical concave member 25 being of a first known diameter and the upper curved portion of the modified convex curved upper end portion 44 being of a curve that if extended into a sphere would be of a substantially larger outer diameter than the known inner diameter of the half spherical concave member 25. The fact that the annular depending flange 45 is of a smaller diameter than the known inner diameter of the half spherical concave member 25, also contributes to the ability of the member 44 to sealingly engage the member 25 in various positions therein.

For example in tests, the apparatus supplied with argon gas at 90 psi at a substantial flow rate by a suitable source, delivers gas at substantially greater than a minimum 40 psi which is essential in bubbling the gas upwardly through a mass of molten metal weighing several tons.

In summary, it will be seen that the apparatus disclosed is relatively simple, durably formed, and so arranged that automatic coupling of the argon or other gas supply is assured despite irregularities in the positioning of the ladle in the tilting mechanism by a crane as normal in steel plant operation.

By referring now to FIG. 4 of the drawings, it will be seen that the gussets 30 are illustrated in position in a corner of the tilting structure 12 and that the ladle 10 and its ladle flange 18 are illustrated diagrammatically with respect to a broken line illustration of the automatic gas hookup apparatus. The supporting beam 32, which is a modified steel I-beam, is illustrated extending from a corner of the tilting structure 12 outwardly to support the upstanding male connection member and those skilled in the art will observe that the arrangement is such that the supporting beam 32 can be adjustably positioned relative to the gussets 31 so as to properly align with and engage the upstanding male connection member in the downwardly facing female connection member of the invention.

Although but one embodiment of the present invention has been illustrated and described, it will be apparent to those skilled in the art that various changes and modifications may be made therein without departing from the spirit of the invention and having thus described my invention what I claim is:

1. An automatic hookup for coupling a ladle to a gas supply for treatment of molten metal in the ladle wherein gas is injected into the molten metal and wherein an annular flange on said ladle rests on ladle saddles in a tilting structure comprising: apertured female connection means depending from said annular flange, said female connection means consisting of a cylindrical body, a half spherical concave member in said cylindrical body, an inverted conical flange depending from said concave member, a support beam on said tilting structure apertured male connection means consisting of telescopic body members on said support beam, spring means on said telescopic body members, an upper plate on said spring means, a convex curved upper end portion having a downturned annular flange, said annular flange secured to said upper plate so as to space said convex curved upper end portion from said upper plate, said half spherical concave member being of a known spherical diameter and said convex curved upper end portion being of a spherical diameter greater than said known diameter of said spherical concave member, means communicating with said ladle and said female connection and means communicating with said male connection and a gas supply.

2. The automatic hookup for coupling a ladle to a gas supply of claim 1 including a pipe communicating with said half spherical concave body member extending upwardly therefrom and a flexible tubular member communicating with said upper plate and extending downwardly therefrom through said spring means and said telescopic body members to a gas supply.

3. The automatic hookup for coupling a ladle to a gas supply of claim 1 wherein said half spherical concave member is positioned within the lower end of said cylindrical body and said upper plate on said spring means is of a diameter less than the interior diameter of said half spherical concave member.

4. The automatic hookup for coupling a ladle to a gas supply of claim 1 wherein said female connection means includes a tube attached to said annular flange on said ladle in registry with an opening therein, a first connection plate having a central opening therein engaged on said tube and a second connection plate having a central opening therein detachably secured to said first connection plate, a pipe communicating with said half spherical concave member extending through said tube and connection plates and through the opening in said annular flange.

5. The automatic hookup for coupling a ladle to a gas supply of claim 1 wherein said male connection means includes a third connection plate having a central opening therein engaged on one of said telescopic body members and a fourth connection plate having a central opening therein detachably secured to said first connection plate, a tubular guide secured to said fourth connection plate and a secondary tubular guide secured to said upper plate, said spring means comprising a coiled spring having its opposite ends engaged over said tubular guide and said secondary tubular guide whereby said convex curved upper end portion of said male connection is urged into sealing relation with said half spherical concave member when the same are engaged.

* * * * *